United States Patent [19]

Scott et al.

[11] Patent Number: 4,498,589

[45] Date of Patent: Feb. 12, 1985

[54] LOCKING HINGE FOR RECLOSABLE PACKAGE

[75] Inventors: Raymond G. Scott, Oak Brook; Sherry M. McNulty, Chicago, both of Ill.

[73] Assignee: Champion International Corporation, Stamford, Conn.

[21] Appl. No.: 606,911

[22] Filed: May 4, 1984

[51] Int. Cl.[3] ..... B65D 43/24; B65D 85/62; B65D 25/08

[52] U.S. Cl. ..... 206/526; 206/470; 206/45.18; 206/449; 220/335; 229/44 R; 426/106; 426/119

[58] Field of Search ..... 206/526, 45.18, 527, 206/449, 461, 469, 470; 220/335; 229/43, 44; 426/106, 119

[56] References Cited

U.S. PATENT DOCUMENTS

| | | | |
|---|---|---|---|
| 3,073,434 | 1/1963 | Fink | 206/45.18 |
| 3,246,792 | 4/1966 | Brackman et al. | 220/335 |
| 3,335,939 | 8/1967 | Robinson, Jr. | 229/43 |
| 3,438,483 | 4/1969 | Miller et al. | 229/43 |
| 3,454,158 | 7/1969 | Tigner | 206/527 |
| 3,488,201 | 1/1970 | Pizarro | 229/43 |
| 3,685,717 | 8/1972 | Seiferth et al. | 229/2.5 |
| 4,091,927 | 5/1978 | Lunsford | 206/461 |

*Primary Examiner*—William T. Dixson, Jr.
*Attorney, Agent, or Firm*—Evelyn M. Sommer

[57] ABSTRACT

A reclosable package comprises a body member of semi-rigid preformed plastic with a first planar marginal portion and a central portion shaped to provide a packaging chamber. A base member has a corresponding second planar marginal portion and a central panel to provide a closure for the packaging chamber. The body member and base member are permanently bonded along one pair of adjacent sides of the first and second planar marginal portions. A hinge is situated within the pair of adjacent sides, which automatically locks when the package is open and unlocks when the package is closed. The hinge may comprise a line of perforations with integral locking tabs situated in one of the sides, or in a mat interposed between the sides. Different patterns of cut configurations may be employed as the hinge as long as the hinge includes areas which protrude to hold the package open when the lid is rotated past 90 to the open position.

13 Claims, 19 Drawing Figures

LOCKING HINGE FOR RECLOSABLE PACKAGE

BACKGROUND OF THE INVENTION

The present invention relates generally to packaging and pertains particularly to a hermetically sealable and reclosable package for sliced meat and the like, which package includes an integral locking hinge.

Current merchandising practices involving sliced meat have popularized hanging display packages which include a transparent plastic leaf with apertured hang tabs attached thereto. U.S. Pat. Nos. 3,298,515; 3,498,018; 3,502,486; 3,685,717; 4,730,739; 4,249,659; 4,278,693; 4,319,684 and British Pat. No. 1,063,685 disclose some of these prior art packages. Producing a hermetic seal in such packages has been an ongoing endeavor, as seen in U.S. Pat. No. 3,734,798, and particularly as it has been an object in the art to produce the ideal reclosable package which is opened easily initially. An attempt to use easily opened selectively adhering materials is disclosed in U.S. Pat. No. 4,285,430.

In the current method of manufacture of a type of hermetically sealed and reclosable display package, a hot melt glue is applied in the margin around the product cavity and each package is then visually inspected to verify that the glue is present in the proper locations and continuously around the perimeter of the cavity.

It would be advantageous to provide a package and a method for forming the package which eliminates the extra labor involved in applying and inspecting hot melt glue.

It is therefore an object of the present invention to provide a hermetically sealable and reclosable package having an integral hinge lock and which eliminates the need and expense of applying and inspecting a hot melt glue seal.

It is a further object of the present invention to provide a structure which reduces or eliminates the need for separate adhesive-backed labels, by providing a mat element which can be imprinted directly with the indicia intended to be carried on the package. Alternatively, it is an object of the present invention to provide a package wherein indicia is directly printed on the base member of the package.

It is a primary object of the present invention to provide a package which will lock in its open position so that the contents of the package can be selectively removed, and which unlocks upon reclosing of the package.

SUMMARY OF THE INVENTION

In accordance with the present invention, a hermetically sealable and reclosable package is provided which comprises a generally rectangular body member of semi-rigid preformed plastic having a first planar marginal portion and a central portion shaped to provide a packaging chamber. The packaging chamber is defined by a closed sidewall and a transversely extending top wall integral therewith. A base member of generally rectangular configuration has a second planar marginal portion and a central raised panel which is shaped to project into and provide a snug fitting closure for the packaging chamber. A generally rectangular mat is sandwiched between the body member and the base member. Means are provided for permanently attaching the mat, along one face thereof, to either one of said first or second planar marginal portions of the body member and base member, peelably attaching the mat along the opposite face thereof to three side edges thereof, while along the remaining edge of the opposite face of the mat, the mat forms a permanent bond so as to enable the package to be opened by a hinged connection.

In a preferred embodiment, portions of the first and second planar marginal portions extend beyond the mat to provide tabs for peeling the body member and base member apart along the peelable sides to open the package. The means for firmly attaching the mat may comprise a coated bonding adhesive or a heat seal coating on the one face of the mat, or a package made of materials in the mat and body or base member that are capable of being permanently heat sealed to themselves. The means for peelably attaching the mat may comprise a coated releasable adhesive or release coat seal on three side edges of the opposite face of the mat, while the fourth side edge is either coated with a permanent sealable coating, or uses materials capable of being permanently bonded to each other by heat sealing.

The mat may be formed of a material which may be printed on one or both sides. In this manner, if the body and/or base members are transparent, printing, on the mat, can be read therethrough, and the need for separate adhesive-backed or pasted labels may be avoided.

A hinge, situated within the permanently bonded side edge provides a pivot or hinge line about which the package opens. Means are provided for automatically locking the hinge when the package is open and unlocking the hinge when the package is closed. The hinge and locking means may comprise a line of perforations with integral locking tabs in either one of the sides of the first or second planar marginal portions, or alternatively in the mat.

The subject invention may also be formed of only two pieces. In one alternate embodiment, the package of the present invention comprises a body member of semi-rigid preformed plastic having a planar marginal portion and a central portion shaped to provide a packaging chamber defined by closed side wall and a transversely extending top wall integral therewith. A paperboard base member has one face of a flexible sheet of plastic material firmly attached thereto. Means is provided for peelably attaching the other face of the flexible sheet to the planar marginal portion of the body member along three sides thereof, and permanently attaching the other face of the flexible sheet to the body member along one side thereof.

In a further embodiment of a two-piece structure, the subject package comprises a body member of semi-rigid preformed plastic having a planar marginal portion and a central portion shaped to provide a packaging chamber defined by closed side wall and a transversely extending top wall integral therewith. A printed, coated plastic base which is formed after printing and coating is provided, and includes either a permanent adhesive coating along one side edge or materials which will bond to each other and a peelable release coating along the remaining three side edges. All printing is done on the base on one or both sides, and the coatings are applied only to the side of the base that adheres to the blister body member.

Still further, the package of the subject invention may be formed by the combination of a body member of semi-rigid preformed plastic and a base member. The semi-rigid preformed plastic includes a planar marginal portion and a central portion shaped to provide a packaging chamber defined by a closed side wall and a transversely extending top wall integral therewith. A paperboard base member including a central aperture substantially corresponding to the shape of the meat product to be packaged is provided and has one face thereof coated with a film of plastic material which is capable of being heat sealed to the plastic body member to form the package. As used, the film of plastic material is permanently heat sealed to the paperboard base member and is permanently sealed along the top edge of the plastic body member but is peelable on the other three sides of the body member providing for opening. In a further modification, the periphery of the aperture in the paperboard base member may include a pattern of cut lines or perforation lines to facilitate stacking of the subject packages.

DETAILED DESCRIPTION OF THE INVENTION

Figure 1:
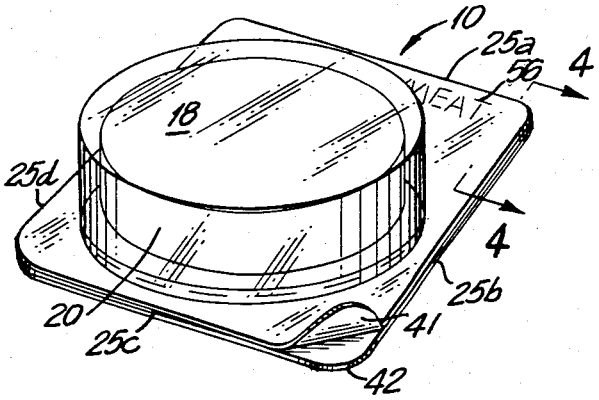
FIG. 1 is a perspective view of a finished package made in accordance with the present invention.
Figure 2:
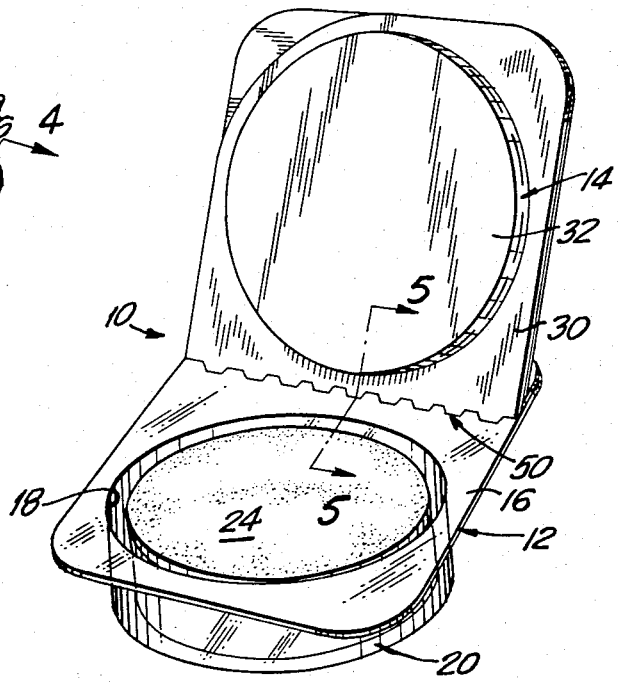
FIG. 2 is a perspective view of the package of the present invention after it has been opened.
Figure 3:
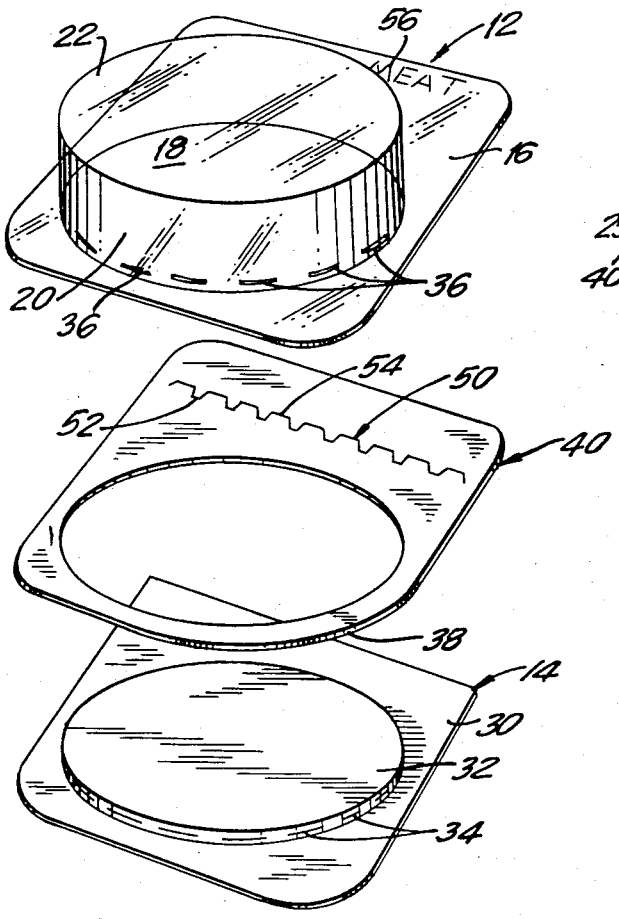
FIG. 3 is an exploded view of the three-piece, plastic package of the present invention before assembly.

Turning to FIGS. 1, 2 and 3, a completed blister package 10 which is made in accordance with the present invention, includes a polygonal body member 12, a base member 14, and a mat 40. The polygonal body member 12 is generally rectangular and comprises a semi-rigid preformed plastic having a first planar marginal portion 16. A central portion of body member 12 is shaped to provide a packaging chamber 18 defined by a closed side wall 20 and a transversely extending top wall 22 integral therewith. Packaging chamber 18 is shaped to contain a product, such as bologna 24 (as shown in FIG. 2), or similar round or square meat products. However, it is to be understood that the packaging chamber 18 may be of any configuration to accommodate other discrete products.

The base member 14 of package 10 has a second planar marginal portion 30 (see FIG. 3) and a central raised panel 32 shaped to project into and provide a snug fitting closure for packaging chamber 18. Ridges 34 may be provided along the edge of panel 32 for interlocking engagement with grooves 36 in packaging chamber 18 when the package is closed.

A mat 40, made of a plastic material is sandwiched between body member 12 and base member 14. As shown in FIGS. 1–3, the body member 12, base member 14 and the mat 40 are generally rectangular in configuration including side edges 25*a*, 25*b*, 25*c* and 25*d*. Mat 40 is firmly attached, or "bonded" to second planar marginal portion 30 of base member 14 along edges 25*a*–25*d*. The other face of mat 40 is peelably attached to first planar marginal portion 16 of body member 12 along edges 25*b*, 25*c* and 25*d*, and permanently attached along edge 25*a*. Those skilled in the art will appreciate that mat 40 could alternatively be firmly bonded to body member 12 and peelably attached to base member 14 along edges 25*b*, 25*c* and 25*d*, and permanently attached along edge 25*a*. In other words, the mat 40 may be either permanently attached along one face thereof to either the body member 12 or the base member 14, as desired by the manufacturer.

In order to facilitate a consumer's opening of the assembled package, mat 40 may be shaped, as shown in the corner area designated by reference number 38 in FIG. 3, to provide tabs 41 and 42 which are actually part of planar marginal portions 16 and 30 respectively, as shown most clearly in FIG. 1. Since no portion of mat 40 is situated between tabs 41 and 42, neither of these tabs will be either firmly attached or peelably attached to mat 40, and thus they will be free to start the peelable opening by the consumer.

Figure 4:
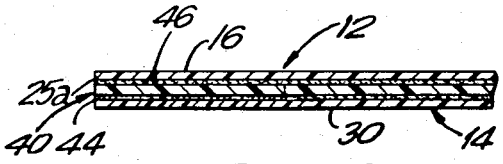
FIG. 4 is a cross-sectional view taken substantially along the line 4—4 shown in FIG. 1.

FIG. 4 is a cross sectional view of the package of FIG. 1 which shows the fixed bonding layer 44 between base member 14 and mat 40, and the permanent seal 46 along edge 25*a* between mat 40 and body member 12. The coating which forms the bonds between the various layers may be rotogravure-printed, coated or laminated and alternatively, mat 40 can have appropriate coating applied by printing or laminating on the opposite faces thereof so that the finished packaged can be sealed through heat sealing techniques.

Another feature of the present invention is the provision of a locking hinge 50 along edge 25*a*, so that the package 10 can be locked in an open position by the consumer. In this manner, a consumer can withdraw a desired quantity of product, e.g. bologna 24, from the package without the inconvenience of having to spread body member 12 and base member 14 totally apart each time another slice of meat is withdrawn. Once a desired quantity of product has been removed from the package, the consumer can then push body member 12 and base member 14 back together, to thereby reclose the package.

The locking hinge arrangement 50 is provided through a hinge 52 and interlocking tabs 54. As shown in FIG. 2, hinge 52 comprises a line of perforations with integral locking tabs 54 disposed in the mat 40.

Figure 5:
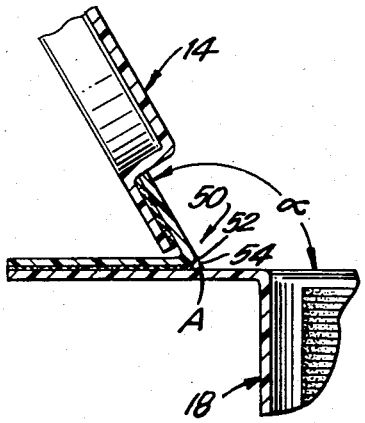
FIG. 5 is a cross-sectional view taken substantially along the line 5—5 of FIG. 2, providing a detailed view of the locking hinge of the present invention.

FIG. 5 is a cross-sectional view which shows, in detail, hinge 52 and the locking arrangement of tabs 54.

Hinge 52 is designed so that integral locking tabs 54 assume a locked position at point A when body member 12 and base member 14 are opened to define an angle $\alpha$ of greater than 90° about hinge 52.

The edge of package 10 designated by numeral 25*a*, as shown in FIG. 1, can comprise a header portion where body member 12 and base member 14 are firmly bonded along one pair of adjacent sides of the first and second planar marginal portions 16 and 30, respectively. This will prevent body member 12 and base member 14 from being peeled apart entirely, since they will be firmly bonded along edge 25*a* of the package.

This portion of package 10 may contain printed indicia 56 which, for example, identifies the package contents. The printed indicia 56 may be applied to mat 40, on one or both faces thereof. When mat 40 is used as the printing medium, body member 12 and/or base member 14 must be transparent or cut short so that the printing is visible and can be read therethrough.

Figure 6:
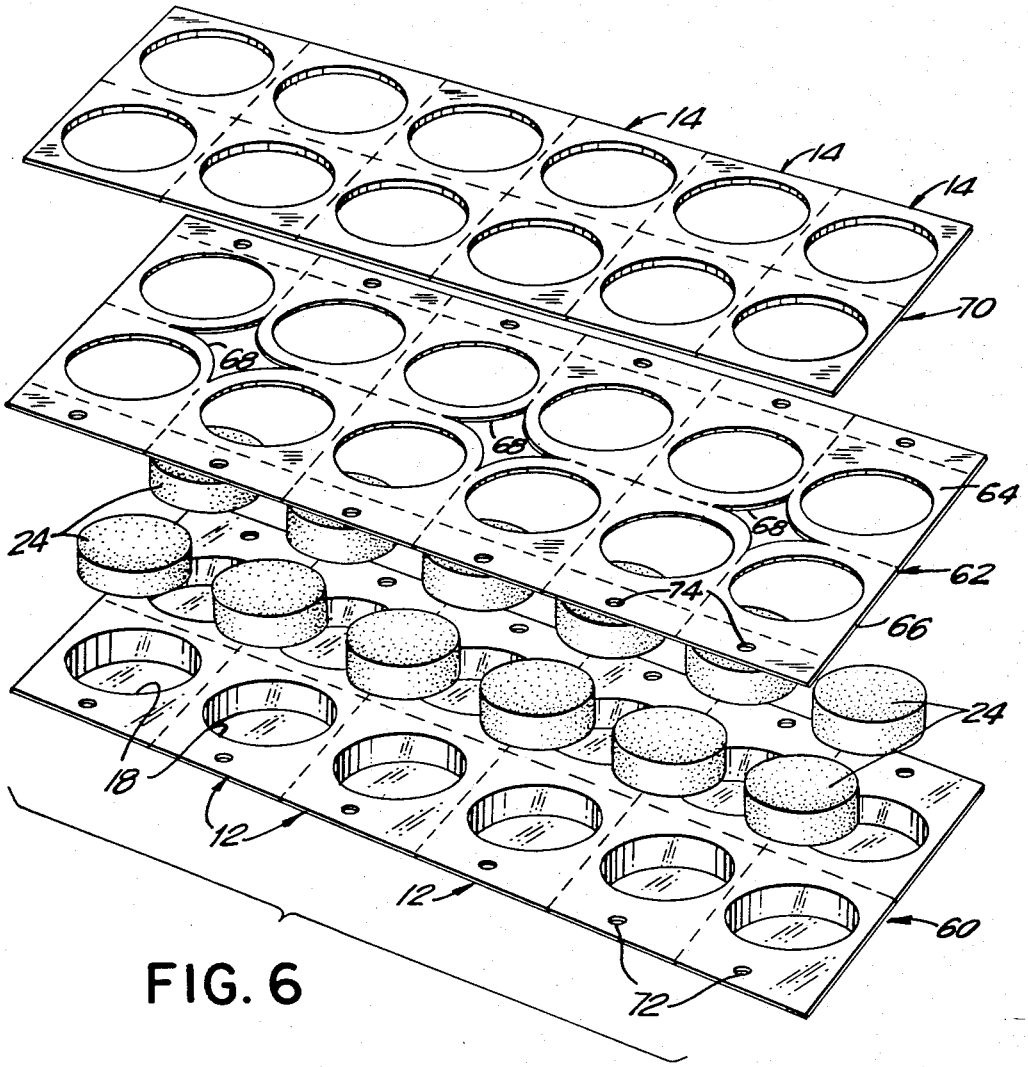
FIG. 6 is an exploded view of a method by which packages in accordance with the invention can be mass produced.

FIG. 6 is an exploded view showing a method for mass producing packages in accordance with the present invention. A blank 60 containing a plurality of body members 12 is supported, in an inverted position, with packaging chambers 18 protruding downwardly. The product to be packaged, e.g. stacks of bologna 24, are placed into the packaging chambers to substantially fill the chambers when the package is completed. A blank 62 containing a plurality of mats 40, having a bonding coating on one of top face 64 or bottom face 66 thereof, and a coating on the other of faces 64 and 66 thereof, is then placed over the plurality of body members 12 of blank 60. It is noted that cut out portions are provided in blank 62 carrying the plurality of mats 40 in order to provide the areas 68 which provide tabs 41 and 42 discussed hereinabove.

After mats 40 are placed over body members 12, a blank 70 containing a plurality of base members 14 is installed to complete the packages. If meat products are involved, conventional means can be used to draw a vacuum if necessary in packaging chambers 18 prior to the final sealing of the packages. After blanks 60,62 and 70 are assembled and sealed, the individual packages are separated from one another along the dashed lines shown in FIG. 6.

The blanks 60,62 and 70 shown in FIG. 6 each preferably include twelve pieces arranged in a two by six matrix. It will be appreciated that other arrangements, with more or fewer pieces per sheet, could be provided. Also shown in blanks 60 and 62 are holes 72 and 74 which, in the finished packages, allow the packages to be hung on a display hook.

The coatings on top face 64 and bottom face 66 of blank 62 may be applied by rotogravure-printing or conventional coating techniques. Either a bonding adhesive or a heat seal coating can be used to provide a firm bond on one of top face 64 or bottom face 66, and the other face can be coated with either a releasable adhesive or a release coat seal to provide for opening of the completed packages along edges 25*b*, 25*c* and 25*d* by peeling body member 12 and base member 14 apart relative to permanently bonded edge 25*a*.

Figure 7:
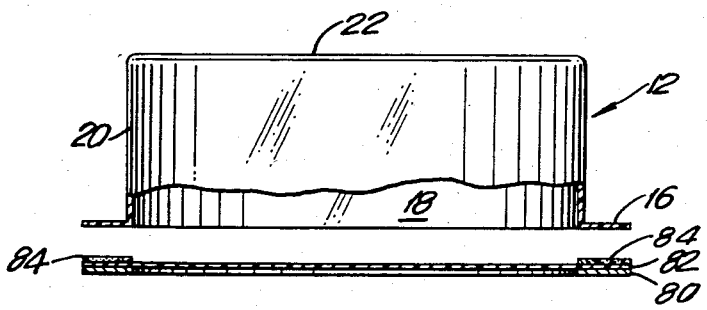
FIG. 7 is a cross-sectional view showing an alternate embodiment in accordance with the present invention.
Figure 8:
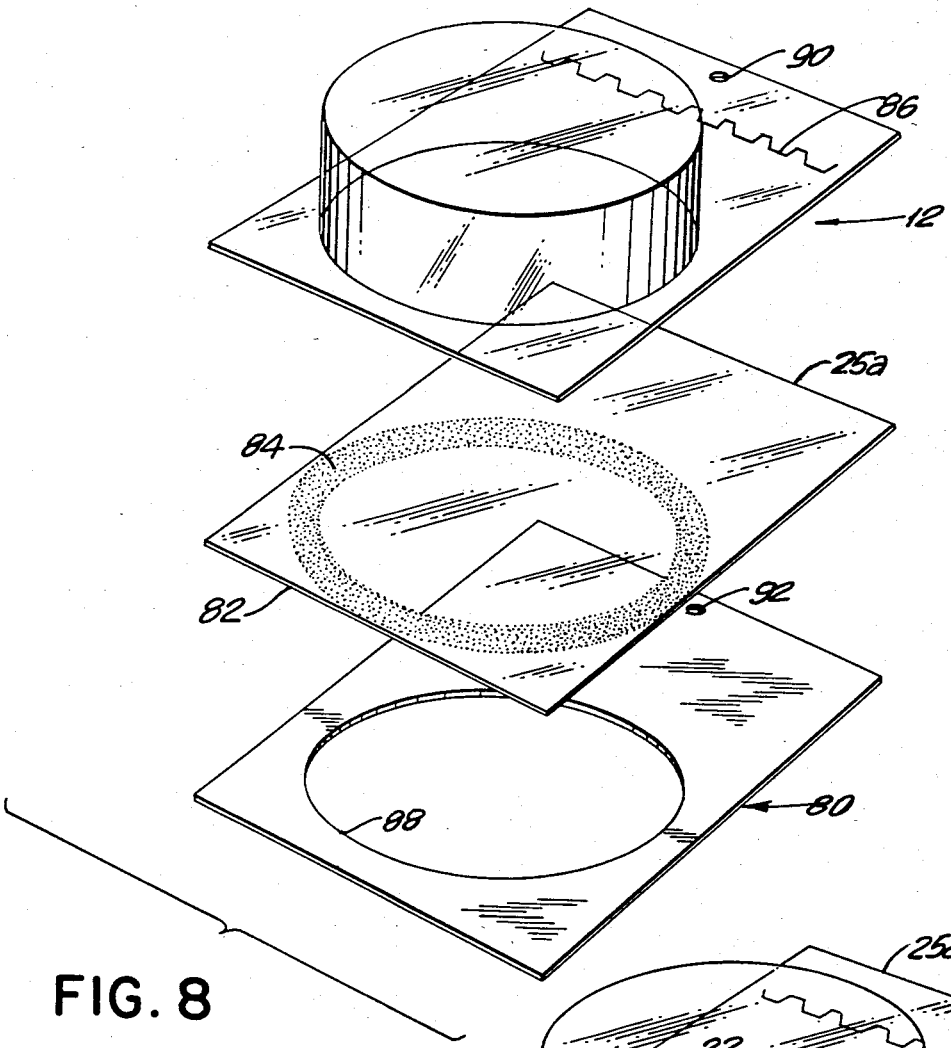
FIG. 8 is an exploded view of the package of FIG. 7.

FIGS. 7 and 8 relate to another embodiment of the present invention. A body member 12 is formed from semi-rigid preformed plastic having a planar marginal portion 16 and a central portion shaped to provide a packaging chamber 18 defined by a closed side wall 20 and a transversely extending top wall 22 integral therewith. A paper base member 80 has one face of a flexible sheet of plastic material 82 firmly attached thereto. The other face of plastic sheet 82 is peelably attached to planar marginal portion 16 of body member 12 through the use of a releasable adhesive or release coat seal 84, and is permanently bonded to planar marginal portion 16 between edge 25*a* and hinge 86 by a suitable adhesive. An opening 88 can optionally be provided in paperboard base member 80 to facilitate the vacuum packaging of a product, such as bologna, in the packaging chamber 18. Holes 90 and 92 are provided in body member 12 and paperboard base member 80 respectively, to enable the completed package to be hung on a rack for display. Body member 12 also includes integral hinge 86 with locking tab members which automatically lock the package in an open condition when body member 12 is pivoted greater than 90° about hinge 86. The locking tabs unlock when the package is closed.

Figure 9:
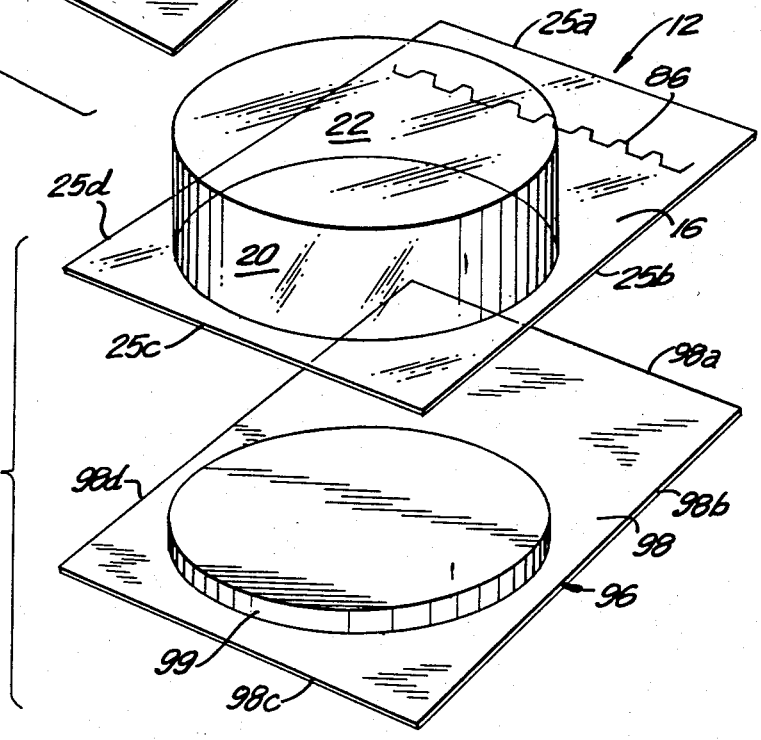
FIG. 9 is an exploded view of a third embodiment of a package made in accordance with the present invention.

Turning to FIG. 9, in another embodiment of the subject invention, a body member 12 is formed from semi-rigid plastic having a planar marginal portion 16 and a central portion shaped to provide a blister packaging chamber defined by a closed side wall 20 and a transversely extending top wall 22 integral therewith. The body member 12 also includes an integral hinge 86. Alternatively, the base member may be formed with an integral hinge. The package further includes base member 96 which has a planar marginal portion 98 and a central raised panel 99 shaped to project into and provide a snug fitting closure for the blister packaging chamber. For securing the body member 12 to the base member 96, a peelable adhesive is provided along the respective side edges 25*b*–*D* and 98*b*–*D*, while a permanent adhesive is provided along the bonded edges 25*a*, 98*a* in the region between the hinge 86 and the edges of planar members. Accordingly, in order to open the blister package, it is merely necessary for the user to separate the body member 12 from the base member 96 for rotation about hinge 86.

Figure 10:
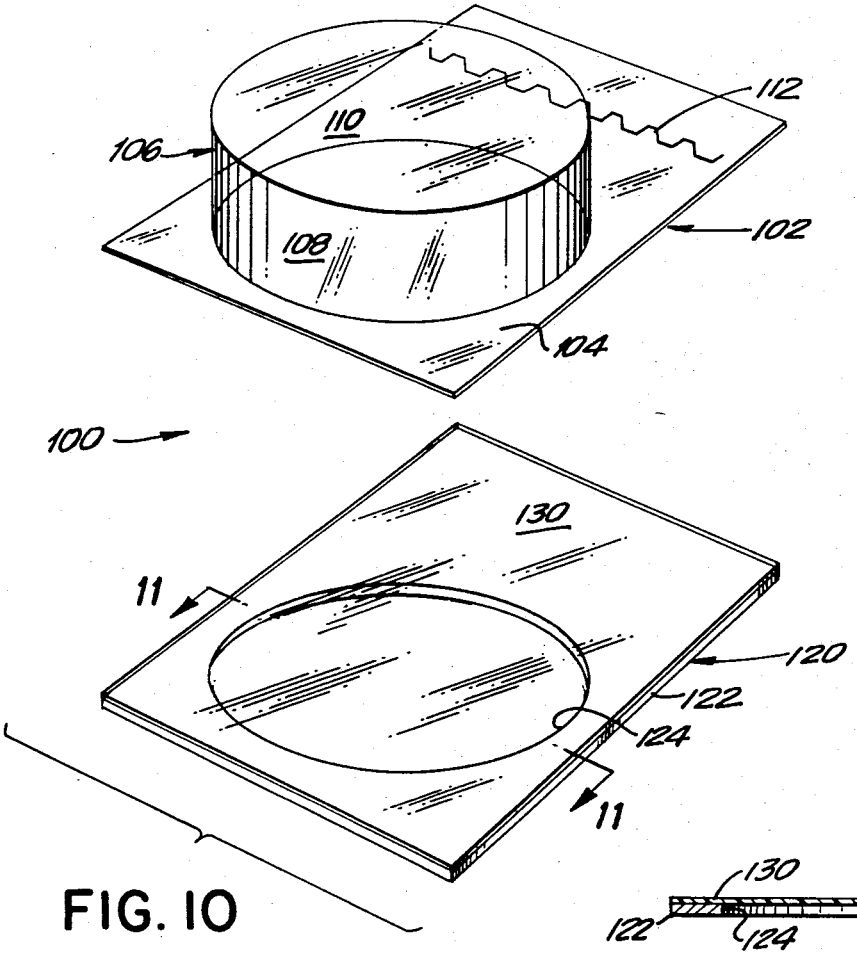
FIG. 10 is an exploded view of a fourth embodiment of a package made in accordance with the present invention.
Figure 11:
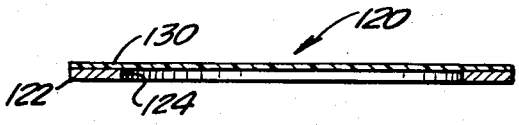
FIG. 11 is a cross-sectional view taken substantially along the line 11—11 of FIG. 10.

Another embodiment of the invention is illustrated in FIGS. 10 and 11. The package 100 comprises a two-piece structure including a body member 102 which is preferably formed from a semi-rigid plastic having a planar marginal portion 104 and a central portion 106 shaped to provide a blister packaging chamber defined by closed side wall 108 and transversely extending top wall 110 integral therewith. The body member 102 also includes an integral hinge 112. A base member 120 is a composite structure of a paper or paperboard substrate 122 having a central aperture 24 corresponding in diameter to the diameter of the chamber of the body member, and a sheet of transparent plastic material 130 bonded to the said substrate and extending substantially across the entire upper surface of the substrate. As more clearly illustrated, in FIG. 11, the composite base member 120 includes the lower recessed portion defined by the aperture 124 thereby enabling stacking of the resulting packages 100. Preferably, the plastic sheet material 130 and the plastic body member 102 are capable of being heat sealed together. For example, the plastic may be BAREX, a polyacrylonitrile material which is manufactured by the Vistron Corporation. Other suitable materials include thermoformable polyester or polyvinylchloride.

Figure 12:
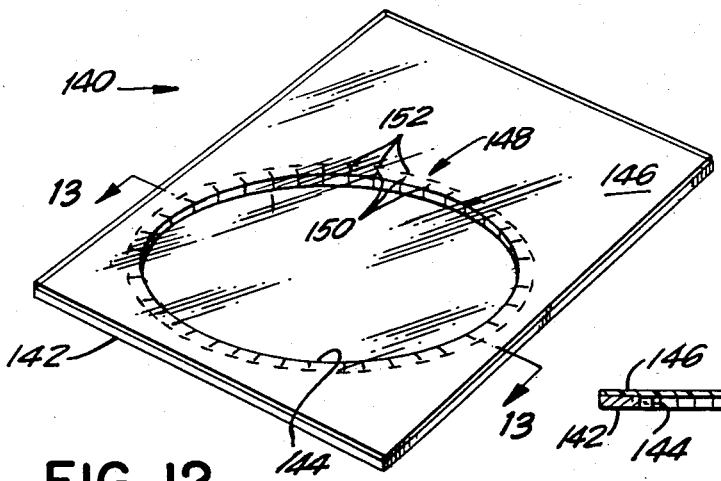
FIG. 12 is a perspective view of an alternate embodiment of a base member made according to the subject invention.
Figure 13:
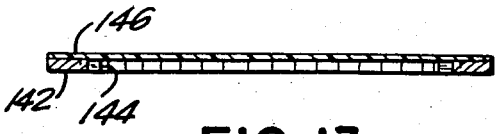
FIGS. 13 and 13A are cross-sectional views taken along line 13—13 of FIG. 12 respectively illustrating the disposition of the base member in the initial and stacked conditions.
Figure 13A:
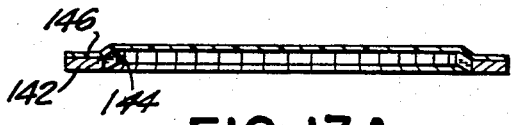

Another embodiment of the subject invention is illustrated in FIGS. 12, 13 and 13A, and also relates to a two-piece structure including a body member (not shown) and a composite base member 140. The latter includes a paper or paperboard substrate 142 to which is adhered a transparent plastic sheet 146 of a material which may be readily heat sealed to the body member. The substrate 142 includes a central aperture 144, with an array of cut lines 148 extending about the periphery thereof. The array of cut lines 148 includes radially extending cut lines 150 and circumferentially-shaped cut lines 152, with each radial cut line 150 being, in turn, spaced from a corresponding circumferential cut line 152, as shown in FIG. 12. As a result, as shown in FIG. 13, a recess is defined in the composite base structure 140 by virtue of the thickness of the paperboard 142 about the periphery of aperture 144. FIG. 13 illustrates the initial condition of the base member 148 preparatory to being assembled with the body member. After the product is disposed in the latter, and the base and body members are assembled, several packages made according to the subject invention may be stacked in a vertical array. At such time, if the diameter of the chamber of the body member is greater than the diameter of the aperture of the interfitting package, the array of cut-lines 148 may be severed to the condition illustrated in FIG. 13A thereby effectively increasing the diameter of the aperture 144 and thus facilitating stacking of the packages. Still further, the ruptured array of cut-lines 148 also enhances the frictional and resilient interengagement of the stacked packages made according to the invention.

Figure 14:
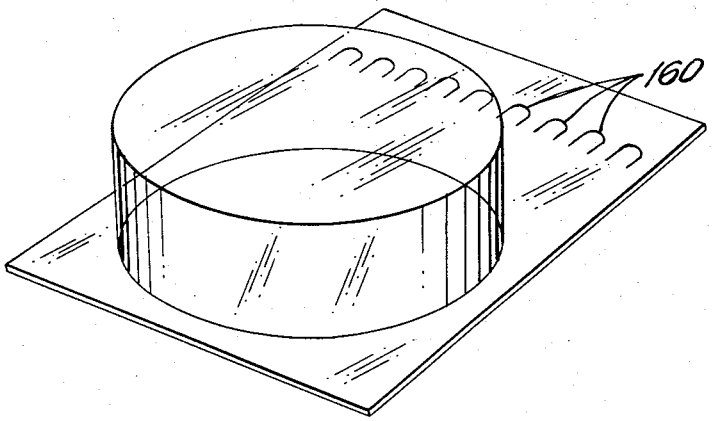
FIG. 14 is a perspective view of a finished package made in accordance with the present invention and including another embodiment of a locking hinge.
Figure 14A:
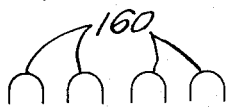
FIGS. 14A, 14B, 14C and 14D are representative of various cut configurations of locking hinges which may be embodied in the subject invention.
Figure 14B:
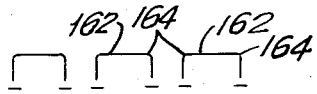
Figure 14C:
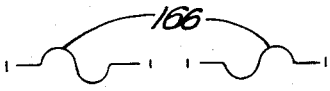
Figure 14D:
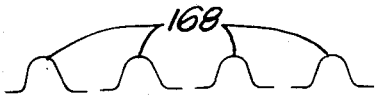

Referring to FIGS. 14–14D, there are illustrated several patterns of cut configurations for forming the hinge of the subject package. In one embodiment as illustrated in FIGS. 14 and 14A, the hinge is formed by a pattern of semi-circular cuts 160 which are in spaced relationship. In the other embodiment illustrated in FIG. 14B, the cuts 162 are elongated and include rounded end portions 164, while a series of sinesoidal cuts 166 which are in spaced relationship define the hinge in the embodiment of FIG. 14C. The hinge illustrated in FIG. 14D includes a series of spaced V-shaped cut-outs 168. In general, any pattern of cut configuration could be employed as long as it provides an area which protrudes at some point at the mat (or blister portion of the package) when opened past 90°. The cuts need not be continuous across the length of the hinge, but could be staggered with score areas therebetween.

Although the invention has been described and illustrated for several preferred embodiments, it is understood that it is capable of modification, and therefore it is desired that the scope of the invention should be interpreted of such changes and alterations as fall within the purview of the following claims.

What is claimed is:

1. In a reclosable package having:

a body member of semi-rigid preformed plastic with a first planar marginal portion and a central portion shaped to provide a packaging chamber, and a base member having a corresponding second planar marginal portion and a central panel to provide a closure for said packaging chamber, said body member and base member permanently bonded together along one pair of adjacent sides of said first and second planar marginal portions;

the improvement comprising a hinge situated within said pair of adjacent sides, and locking means for automatically locking said hinge when said package is open and unlocking said hinge when said package is closed.

2. The package of claim 1 wherein said hinge and locking means comprises a line of perforations with integral locking tabs in one of said sides.

3. The package of claim 2 wherein each said locking tab is generally semi-circular in configuration.

4. The package of claim 2 wherein each said locking tab is elongated with rounded end portions.

5. The package of claim 2 wherein each said locking tab is sinesoidal in configuration.

6. The package of claim 2 wherein each said locking tab is generally V-shaped in configuration.

7. The package of claim 2 wherein said hinge and locking means is situated in said first planar marginal portion.

8. The package of claim 2 wherein said hinge and locking means is situated in said second planar marginal portion.

9. The package of claim 2 wherein said integral locking tabs assume a locked position when said base and body member are opened to define an angle of greater than 90° about said hinge.

10. A reclosable package comprising:

a body member of semi-rigid preformed plastic with a first planar marginal portion and a central portion shaped to provide a packaging chamber;

a base member having a corresponding second planar marginal portion and a central panel to provide a closure for said packaging chamber;

a mat sandwiched between said body member and said base member;

means for permanently bonding said mat, along one face thereof, to one of said first or second planar marginal portions;

means for permanently bonding said mat, along one side of the other face thereof, to the adjacent side of the other of said first or second planar marginal portions, thereby forming a header portion;

a hinge situated along said header portion; and means for automatically locking said hinge when said package is open and unlocking said hinge when said package is closed.

11. The package of claim 10 wherein said hinge and locking means comprises a line of perforations with integral locking tabs situated in said mat.

12. The package of claim 11 wherein said integral locking tabs assume a locked position when said base and body member are opened to define an angle of greater than 90° about said hinge.

13. The package of claim 12 wherein said mat is peelably attached along the remaining sides of the other face thereof to the remaining sides of the other of said first or second planar marginal portions.

* * * * *